US007841842B2

(12) United States Patent
Yajima

(10) Patent No.: US 7,841,842 B2
(45) Date of Patent: Nov. 30, 2010

(54) CHEMICAL LIQUID SUPPLYING APPARATUS

(75) Inventor: Takeo Yajima, Tokyo (JP)

(73) Assignee: Koganei Corporation, Tokyo (JP)

( * ) Notice: Subject to any disclaimer, the term of this patent is extended or adjusted under 35 U.S.C. 154(b) by 570 days.

(21) Appl. No.: 11/856,820

(22) Filed: Sep. 18, 2007

(65) Prior Publication Data

US 2008/0138214 A1 Jun. 12, 2008

(30) Foreign Application Priority Data

Nov. 29, 2006 (JP) ..... 2006-322235

(51) Int. Cl.
*F04B 43/10* (2006.01)
*F04B 45/00* (2006.01)

(52) U.S. Cl. ..... 417/394; 417/383; 417/389; 417/395

(58) Field of Classification Search ..... 417/383, 417/388, 389, 392, 394, 395, 426
See application file for complete search history.

(56) References Cited

U.S. PATENT DOCUMENTS

| | | | | |
|---|---|---|---|---|
| 2,613,607 | A * | 10/1952 | Sheen et al. | 417/388 |
| 2,853,015 | A * | 9/1958 | Pleuger | 417/389 |
| 3,318,251 | A * | 5/1967 | Smith | 417/339 |
| 3,902,826 | A * | 9/1975 | Nagel et al. | 417/386 |
| 4,178,133 | A * | 12/1979 | Rawicki | 417/63 |
| 4,474,540 | A * | 10/1984 | Bonastia et al. | 417/63 |
| 5,165,869 | A * | 11/1992 | Reynolds | 417/385 |
| 5,167,837 | A | 12/1992 | Snodgrass et al. | |
| 6,183,223 | B1 | 2/2001 | Yajima | |
| 6,193,783 | B1 | 2/2001 | Sakamoto et al. | |

FOREIGN PATENT DOCUMENTS

| | | |
|---|---|---|
| JP | 10-061558 | 3/1998 |
| JP | 2000-012449 | 1/2000 |
| JP | 2002-242842 A | 8/2002 |
| JP | 2004-050026 | 2/2004 |
| JP | 2006-266250 A | 10/2006 |
| JP | 200825561 | 2/2008 |

OTHER PUBLICATIONS

Office Action issued in corresponding application No. JP2006-322235 and its English translation dated Mar. 10, 2010. (5 pages.).

* cited by examiner

*Primary Examiner*—Devon C Kramer
*Assistant Examiner*—Peter J Bertheaud
(74) *Attorney, Agent, or Firm*—McCormick, Paulding & Huber LLP

(57) ABSTRACT

A chemical liquid supplying apparatus capable of discharging chemical liquid with high accuracy and monitoring a leakage of an incompressible medium from a region between a piston and a cylinder is provided. A pump has a flexible tube for partitioning a pump chamber and a drive chamber, and the incompressible medium is supplied to the drive chamber by the piston reciprocating within a cylinder hole of the cylinder. A first bellows cover for forming a first seal chamber is provided between a large-diameter piston portion and the cylinder, and a second bellows cover for forming a second seal chamber is provided between a small-diameter piston portion and the cylinder. To detect pressure of the incompressible medium enclosed in the seal chambers, a seal-chamber pressure sensor is attached to the cylinder, and a deterioration degree of seal members is determined by detecting the pressure.

2 Claims, 6 Drawing Sheets

CHEMICAL LIQUID SUPPLYING APPARATUS

CROSS-REFERENCE TO RELATED APPLICATIONS

Applicant hereby claims foreign priority benefits under U.S.C. §119 from Japanese Patent Application No. 2006-322235 filed on Nov. 29, 2006, the contents of which are incorporated by reference herein.

TECHNICAL FIELD OF THE INVENTION

The present invention relates to a chemical liquid supplying apparatus which discharges a predetermined amount of chemical liquid such as photoresist liquid.

BACKGROUND OF THE INVENTION

A fine circuit pattern is produced on a surface of a semiconductor wafer or liquid crystal glass substrate by a photolithography process and an etching process. In the photolithography process, a chemical liquid supplying apparatus has been used to apply chemical liquid such as photoresist liquid to a surface of wafer or glass substrate, and the chemical liquid accommodated in a container is sucked up by a pump, passes through a filter or the like, and is applied to an object to be applied such as a wafer from a nozzle. Japanese Patent Application Laid-Open Publication No. 2000-12449 (Patent Document 1) describes a treatment liquid supplying apparatus for supplying wafer photoresist liquid, and Japanese Patent Application Laid-Open Publication No. 2004-50026 (Patent Document 2) describes an application apparatus for supplying photoresist liquid to a liquid crystal glass substrate.

In such a chemical liquid supplying apparatus, if particles such as dust and dirt are mixed in the chemical liquid to be applied, they adhere to the object to be applied, whereby any pattern defects are caused and a yield of products is reduced. If the chemical liquid in the container is accumulated in a pump, it changes in quality. Therefore, since the chemical liquid changed in quality may become particles in some cases, the pump for discharging the chemical liquid is demanded not to be accumulated.

A pump in which a pump chamber supplying the chemical liquid and a drive chamber expanding/contracting the pump chamber are partitioned by an elastically deformable diaphragm or a partition film such as a tube is used as a pump for discharging the chemical liquid. The drive chamber is filled with indirect liquid, namely, an incompressible medium so as to pressurize the chemical liquid through the partition film. A pressurizing system of the incompressible medium includes a bellows type as described in Japanese Patent Application Laid-Open No. 10-61558 (Patent Document 3) and a syringe type of using a piston as disclosed in U.S. Pat. No. 5,167,837 (Patent Document 4).

SUMMARY OF THE INVENTION

When the diaphragm or tube is elastically deformed by the incompressible medium to perform a pump operation, accumulation of the chemical liquid can be prevented in an expansion/contraction chamber of the pump. Therefore, although generation of the particles due to the accumulation of the chemical liquid can be prevented, the incompressible medium results in playing an important role in determining performance of the pump. That is, if air enters into the incompressible medium from the outside, incompressibility of the incompressible medium is macroscopically lost, so that motion of the bellows or piston cannot be accurately transmitted to the diaphragm or tube and a movement stroke of the bellows or piston results in not corresponding to a discharge amount of chemical liquid. Further, similarly thereto, also when the incompressible medium leaks out, the movement stroke of the bellows results in not corresponding to the discharge amount of chemical liquid, so that the chemical liquid cannot be discharged with high accuracy.

In the pump of the syringe type disclosed in Patent Document 4 mentioned above, a seal member contacting with an outer peripheral surface of the piston is generally provided on the cylinder to seal a region between an interior of the drive chamber on a tip face side of the piston and an exterior on a basal end face side of the piston, whereby the piston regards the seal member as a boundary to reciprocate between a portion in which the incompressible medium exists and the outside. Thus, the incompressible medium is sometimes exposed to the outside while adhering to the outer peripheral surface of the piston. The adhering incompressible medium becomes a thin-file shape and enters into a region between the outer peripheral surface of the piston and the seal member, thereby serving as lubricant to avoid direct contact between the seal member and the outer peripheral surface of the piston. However, since part of the incompressible medium exposed to the outside evaporates or dries little by little, it disappears from the surface of the piston and an amount of incompressible medium is reduced. Further, if the incompressible medium exposed to the outside vaporizes, the incompressible medium serving as lubricant disappears from the outer peripheral surface of the piston and becomes in no oil-film state. Consequently, the seal member directly contacts with the outer peripheral surface of the piston, whereby wear of the seal member progresses.

When the drive chamber partitioned by the partition film is expanded and the piston moves backward in order to suck the chemical liquid in the container into the pump chamber, since the incompressible medium becomes in a negative pressure state, ambient air may enter into the incompressible medium in the drive chamber from a region between the outer peripheral surface of the piston and an inner peripheral surface of the cylinder. This phenomenon becomes significant when the seal member slidably contacting with the outer peripheral surface of the piston is worn and a sealing property is lowered, and the same phenomenon occurs even when large negative pressure is applied to the incompressible medium by the piston.

Contrary to this, since the pump of the above-mentioned bellows type does not use the seal member contacting with the sliding face, there is the advantage that airtight properties of the drive chamber filled with the incompressible medium and the pump chamber pressurizing the chemical liquid are high. However, there is a tendency to the fact that pressure applied to the incompressible medium in the bellows type is lower than that in the syringe type. For example, when resist is discharged to the nozzle through a filter, since flow resistance of the filter is high, the pressure in the pump chamber needs to be increased. Consequently, when the bellows is driven, the pressure of the incompressible medium in the drive chamber becomes high, so that the bellows may be expanded slightly radially. At this time, if the bellows is expanded, a movement stroke of the bellows results in not corresponding to the discharge amount of chemical liquid with high accuracy.

The pump of the above-mentioned syringe type is preferred to increase discharge pressure of the pump. However, as wear of the seal member progresses, the incompressible medium in the drive chamber results in leaking to the outside. Thus, the seal member may be replaced periodically. Similarly also in a chemical-liquid discharge pump of a type of preventing a leakage of the incompressible medium in the drive chamber by narrowing a gap between the outer peripheral surface of the piston and the inner peripheral surface of the cylinder, as the wear of the sliding face between the piston and the cylinder progresses, the incompressible medium in the drive chamber leaks to the outside, so that the piston and the cylinder need to be replaced.

Accordingly, if any leakage of the incompressible medium in the drive chamber from the sliding face between the piston and the cylinder can be detected from the outside, a replacement period of the seal member and a replacement period of the piston, etc. can be determined.

An object of the present invention is to provide a chemical liquid supplying apparatus which can monitor any leakage of the incompressible medium in the drive chamber from the gap between the piston and the cylinder.

Another object of the present invention is to provide a chemical liquid supplying apparatus which can determine lifetime by an amount of leakage of the incompressible medium in the drive chamber.

A chemical liquid supplying apparatus according to the present invention comprises: a pump provided with an elastically deformable partition film for partitioning a pump-side drive chamber and a pump chamber communicating with a liquid inflow port and a liquid outflow port; a cylinder connected to the pump, a large-diameter cylinder hole and a small-diameter cylinder hole being formed in the cylinder; a piston having a large-diameter piston portion fitted into the large-diameter cylinder hole and a small-diameter piston portion fitted into the small-diameter cylinder hole, mounted axially reciprocably inside the cylinder, forming in the cylinder a piston-side drive chamber communicating with the pump-side drive chamber, and supplying/exhausting an incompressible medium to/from the pump-side drive chamber; a bellows cover provided between the large-diameter piston portion and the cylinder, and forming a first seal chamber continuous to a sliding face of the large-diameter piston portion; an elastic deformable member provided between the small-diameter piston portion and the cylinder, and forming a second seal chamber continuous to a sliding face of the small-diameter piston portion, the second seal chamber communicating with the first seal chamber; the incompressible medium enclosed in the first and second seal chambers; a drive means for reciprocating axially the piston to expand/contract the pump chamber through the incompressible medium in the piston-side drive chamber and the pump-side drive chamber; and a pressure detecting means for detecting pressure in at least one of the seal chamber and the drive chamber. In the chemical liquid supplying apparatus according to the present invention, the elastic deformable member is a bellows cover. The respective bellows covers are disposed coaxially and are synchronously driven by the drive means.

A chemical liquid supplying apparatus according to the present invention comprises: a cylinder having a large-diameter outer peripheral surface and a small-diameter outer peripheral surface; a flexible tube incorporated in the cylinder to partition a pump-side drive chamber between a pump-side drive chamber and a pump chamber communicating with a liquid inflow port and a liquid outflow port, the pump-side drive chamber being between an inner peripheral surface of the cylinder and the flexible tube; a piston having a large-diameter piston portion fitted slidably into the large-diameter outer peripheral surface and a small-diameter piston portion fitted slidably into the small-diameter outer peripheral surface, and supplying/exhausting an incompressible medium to/from the pump-side drive chamber, a piston-side drive chamber communicating with the pump-side drive chamber being formed between the cylinder and the piston; a first bellows cover provided between one end portion side of the cylinder and the large-diameter piston portion of the piston, and forming a first seal chamber continuous to a sliding face of the large-diameter piston portion between the large-diameter outer peripheral surface and the first seal chamber; a second bellows cover provided between the other end portion side of the cylinder and the small-diameter piston portion of the piston, and forming a second seal chamber continuous to the sliding face of the small-diameter piston portion between the small-diameter outer peripheral surface and the second seal chamber, the second seal chamber communicating with the first seal chamber; the incompressible medium enclosed in the first and second seal chambers; a drive means for reciprocating axially the piston to expands/contracts the pump chamber through the incompressible medium in the piston-side drive chamber and the pump-side drive chamber; and a pressure detecting means for detecting pressure in at least one of the seal chamber and the drive chamber. In this chemical liquid supplying apparatus, two bellows covers are coaxially disposed and synchronously driven by the drive means, and further the piston is disposed outside the cylinder.

A chemical liquid supplying apparatus according to the present invention comprises: a pump provided with an elastically deformable partition film for partitioning a drive chamber and a pump chamber communicating with a liquid inflow port and a liquid outflow port; a cylinder incorporating reciprocably, into the drive chamber, a piston for supplying/exhausting an incompressible medium to/from the drive chamber; an axially elastically deformable bellows cover provided between the piston and the cylinder and forming a first seal chamber continuous to a sliding face of the piston, the incompressible medium being enclosed in the first seal chamber; a second bellows cover forming a second seal chamber continuous to the first seal chamber, the incompressible medium being supplied/exhausted to/from the second seal chamber according to a volume change of the first seal chamber at a time of reciprocating the piston; a drive means for reciprocating axially the piston and the second bellows cover to expand/contract the pump chamber through the incompressible medium, the drive means expanding the second seal chamber when the first seal chamber is contracted and contracting the second seal chamber when the first seal chamber is expanded; and a pressure detecting means for detecting pressure in at least one of the seal chamber and the drive chamber. In this chemical liquid supplying apparatus, two bellows covers are disposed in parallel and synchronously driven by the drive means.

A chemical liquid supplying apparatus according to the present invention comprises: a pump provided with an elastically deformable partition film for partition a drive chamber and a pump chamber communicating with a liquid inflow port and a liquid outflow port; a cylinder incorporating reciprocably, into the drive chamber, a piston for supplying/exhausting an incompressible medium to/from the drive chamber; an axially elastically deformable bellows cover provided between the piston and the cylinder, and forming a first seal chamber continuous to a sliding face of the piston, the incompressible medium being enclosed in the first seal chamber; an elastic deformable member forming a second seal chamber communicating with the first seal chamber, the incompressible medium being supplied/exhausted to/from the second seal chamber according to a volume change of the first seal chamber at a time of reciprocating the piston; a drive means for reciprocating axially the piston to expand/contract the pump chamber through the incompressible medium; and a pressure detecting means for detecting pressure in at least one of the seal chamber and the drive chamber. In the chemical liquid supplying apparatus, the elastic deformable member is a diaphragm, and the diaphragm serving as the elastically deformable member is elastically deformed by the medium from the first seal chamber.

According to the present invention, the drive chamber filled with the incompressible medium is expanded/contracted by the piston to expand/contract the pump chamber through the incompressible medium, higher pressure can be applied to the incompressible medium than pressurization applied to the incompressible medium by the bellows. Consequently, even if higher flow resistance is applied to the pump chamber when the pump chamber is contracted, the chemical liquid can be supplied.

The first seal chamber continuous to the sliding face between the piston and the cylinder is formed by the elastic deformable member such as a bellows cover provided between the piston and the cylinder, and the second seal chamber communicating with the first seal chamber is formed by the elastic deformable member, wherein the incompressible medium is enclosed in each of the seal chambers. Thus, since the elastic deformable member for forming the seal chamber(s) has no sliding portion, the leakage of the incompressible medium from the elastic deformable member can be prevented completely. Therefore, even if the incompressible medium enclosed inside leaks from a region between the sliding face of the piston and the sliding face of the cylinder by pressurizing the drive chamber using the piston, the incompressible medium flows into the seal chamber, so that the leakage of the incompressible medium to an exterior of the apparatus is prevented.

If the seal member provided between the sliding face of the piston and the sliding face of the inner peripheral surface of the cylinder hole is worn, or if the sliding faces are worn at a time of providing no seal member between both the sliding faces and securing a sealing property therebetween, the sealing property is deteriorated so that the incompressible medium leaks from the drive chamber into the seal chamber. Because the pressure in the seal chamber changes when the incompressible medium leaks, the deterioration degree of the sealing property corresponding to the amount of leakages of the incompressible medium can be determined by detecting the pressure in the seal chamber. The lifetime of the seal member can be determined based on the deterioration degree of the sealing property, or the lifetime of the piston or the like can be determined at a time of using no seal member.

Because a pressure change characteristic of the drive chamber is varied when the sealing property is deteriorated, the deterioration degree of the sealing property can be detected by detecting the pressure in the drive chamber. Consequently, the lifetime and the like of the seal member can be determined similarly.

By detecting the pressure in the seal chamber and the pressure in the drive chamber, the deterioration degree of the sealing property can be determined more accurately in view of an influence of the pressure change of the seal chamber due to the pressure change of the drive chamber.

DESCRIPTION OF THE PREFERRED EMBODIMENTS

Figure 1:
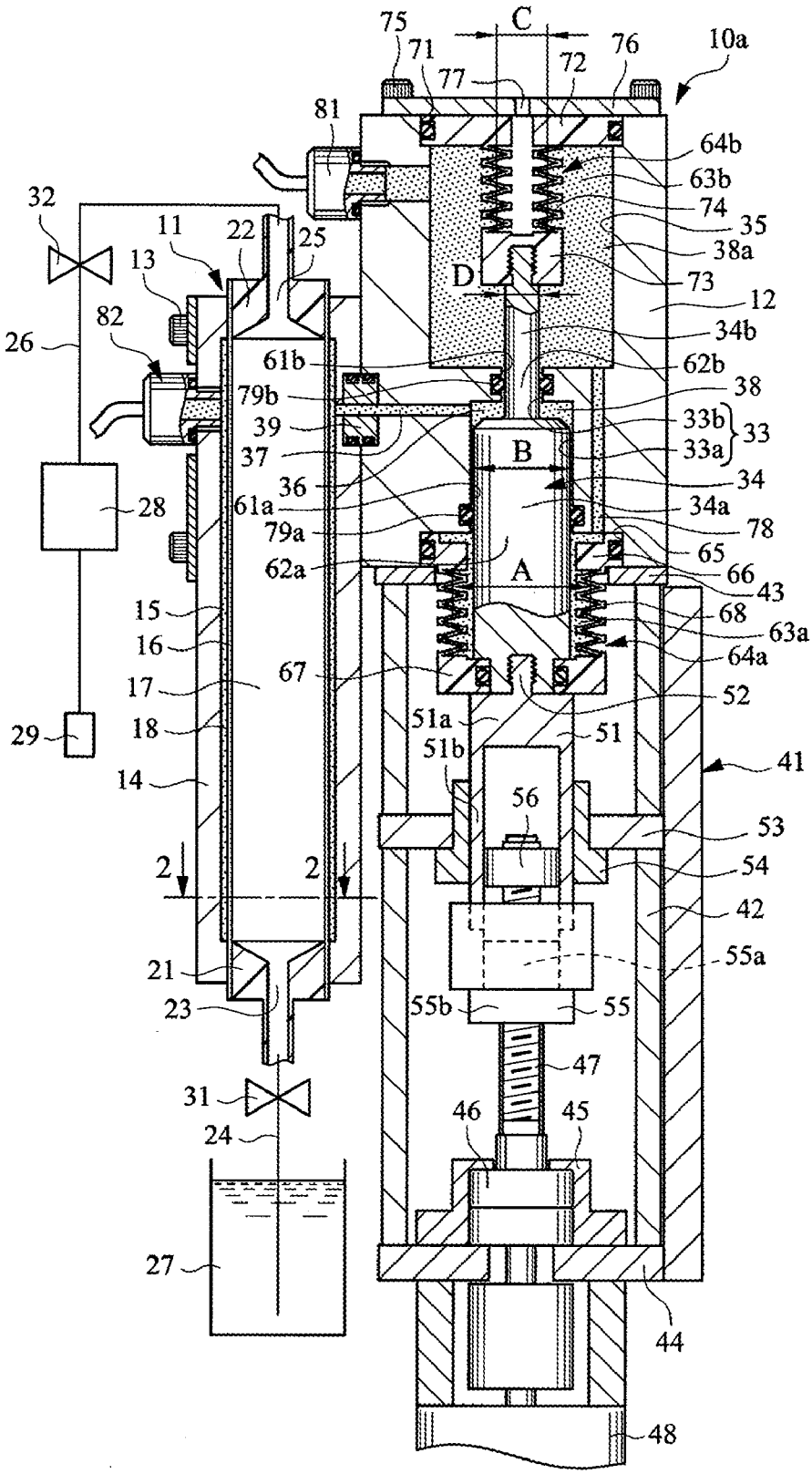
FIG. 1 is a sectional view showing a chemical liquid supplying apparatus according to an embodiment of the present invention.

Hereinafter, embodiments of the present invention will be described in detail with reference to the drawings. FIG. 1 is a sectional view showing a chemical liquid supplying apparatus according to an embodiment of the present invention.

This chemical liquid supplying apparatus 10*a* comprises a pump 11 and a cylinder 12. The pump 11 has a pump case 14 fixed to the cylinder 12 by bolts 13, and a flexible tube 16 attached within a cylindrical space 15 in the pump case 14. The flexible tube 16 is formed of a radially expandable/contractable elastic member, and the space 15 is partitioned by the flexible tube 16 into a pump chamber 17 located inside the flexible tube and a pump-side drive chamber 18 located outside the flexible tube, so that the flexible tube 16 constitutes a partition film.

Adaptor portions 21 and 22 are attached on both end portions of the flexible tube 16. A liquid inflow port 23 communicating with the pump chamber 17 is formed on the adapter portion 21 and a supply-side flow path 24 is connected thereto. A liquid outflow port 25 communicating with the pump chamber 17 is formed on the adapter portion 22 and a discharge-side flow path 26 is connected thereto. The supply-side flow path 24 is connected to a chemical-liquid tank 27 which accommodates chemical liquid such as resist liquid, and the discharge-side flow path 26 is connected to an application nozzle 29 through a filter 28.

The flexible tube 16 is formed of tetrafluoroetylene perfluoroalkyl vinylether copolymer (PFA), which is a fluorine resin, and the adapter portions 21 and 22 are also formed of PFA. These members formed of PFA do not react with photoresist liquid. However, those members are not limited to PFA by kinds of used liquid, and a flexible material such another resin material or rubber material may be used as a raw material of the flexible tube 16 as long as being elastically deformed. Another resin material or metal material may be used as a raw material of each of the adapter portions 21 and 22.

The supply-side flow path 24 is provided with a supply-side opening/closing valve 31 for opening/closing this flow path, and the discharge-side flow path 26 is provided with a discharge-side opening/closing valve 32 for opening/closing this flow path. Each of the opening/closing valves 31 and 32 includes a solenoid valve which is actuated according to an electric signal, a motor-driven valve, or an air operation valve which is actuated by pneumatic pressure. Further, a check valve may be used.

A cylinder hole 33 is formed on a basal end portion side of the cylinder 12, and a piston 34 is installed axially reciprocably in the cylinder hole 33. The cylinder hole 33 has a large-diameter cylinder hole 33*a* and a small-diameter cylinder hole 33*b* communicating therewith, wherein the large-diameter cylinder hole 33*a* is opened to an opening portion located on the basal end portion side of the cylinder 12. On the other hand, the small-diameter cylinder hole 33*b* is opened to an accommodating hole 35 formed on a tip portion side of the cylinder 12, and communicates with the large-diameter cylinder hole 33*a* and the small-diameter cylinder hole 33*b*. The piston 34 has a large-diameter piston portion 34*a* fitted to the large-diameter cylinder hole 33*a* and a small-diameter piston portion 34*b* fitted to the small-diameter cylinder hole 33*b*, wherein the small-diameter piston portion 34*b* protrudes into the accommodating hole 35.

A piston-side drive chamber 36 is formed between the large-diameter piston portion 34*a* and a bottom face of the large-diameter cylinder hole 33*a*, and the piston-side drive chamber 36 communicates with the pump-side drive chamber 18 through a communicating hole 37 formed in the cylinder 12. Liquid as an incompressible medium 38 for driving is enclosed in both the drive chambers 18 and 36, and the incompressible medium 38 in the drive chamber 18 communicates with that in the drive chamber 36 through the communicating hole 37. Accordingly, when the piston 34 is moved forward in a direction in which the large-diameter piston portion 34*a* approaches the bottom face of the large-diameter cylinder hole 33*a*, the piston-side drive chamber 36 is contracted so that the incompressible medium 38 in the drive chamber 36 flows into the pump-side drive chamber 18, whereby the pump chamber 17 inside the flexible tube 16 is contracted. On the other hand, when the piston 34 is moved backward, the piston-side drive chamber 36 is expanded so that the incompressible medium 38 in the pump-side drive chamber 18 flows into the drive chamber 36, whereby the pump chamber 17 is expanded.

In the pump 11 having the flexible tube 16 and the pump case 14, when the piston 34 in the cylinder 12 is reciprocated, the pump chamber 17 is expanded/contracted by movement of the incompressible medium 38 enclosed in both the drive chambers 18 and 36 and the supply-side opening/closing valve 31 and the discharge-side opening/closing valve 32 are opened/closed in conjunction with expansion/contraction of the pump chamber 17, so that the chemical liquid in the chemical-liquid tank 27 is supplied to the application nozzle 29.

The pump case 14 constituting the pump 11 is attached to the cylinder 12, and a seal piece 39 with a seal member is built between the pump case 14 and the cylinder 12 in order to prevent a leakage of the incompressible medium 38 from a region between the pump case 14 and the cylinder 12. However, the pump case 14 and the cylinder 12 may be formed by an integral member. Further, the pump case 14 may be separated from the cylinder 12 and then the pump case 14 and the cylinder 12 may be connected through a hose or tube having a communicating hole.

Figure 2:
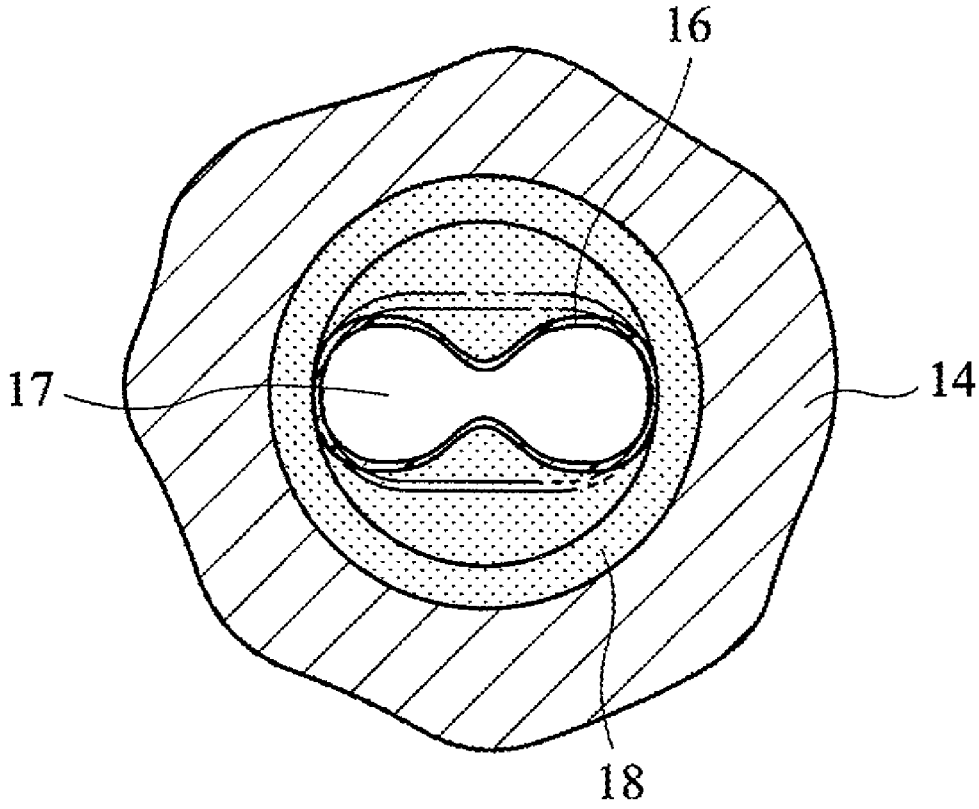
FIG. 2 is a sectional view taken along line 2-2 of FIG. 1.

FIG. 2 is a sectional view taken along line 2-2 in FIG. 1. The flexible tube 16 as a pump member has an elongated circle shape in cross section except portions to be fitted to the adapter portions 21 and 22, and comprises flat portions and circular arc portions. When the piston 34 reaches almost a forward limit position as shown in FIG. 1, the flexible tube 16 is contracted so that the flat portions approach each other as shown by solid lines in FIG. 2. When the piston 34 reaches a backward limit position, the flexible tube 16 turns to the elongated circular shape so that the flat portions are parallel to each other as shown by double-dot lines in FIG. 2. However, a lateral sectional shape of the flexible tube 16 is not limited to the elongated circular shape and may be formed into another shape such as a circular.

The cylinder 12 is attached to a drive box 41, and the drive box 41 has a box main body 42 with a rectangular section, wherein end walls 43 and 44 are fixed to both ends of the box main body. A bearing 46 is fixed on an inner face of the end wall 44 by a bearing holder 45, and a ball screw shaft 47 is supported by the bearing 46 so as to be rotatable at a basal end portion of the ball screw shaft. The ball screw shaft 47 is connected to a main shaft of a motor 48 serving as drive means fixed outside the end wall 44, so that the ball screw shaft 47 is rotated both in normal and inverse directions by the motor 48.

A drive sleeve 51 is linked to a rear end of the piston 34, and the drive sleeve 51 has: an end wall portion 51*a* provided integrally with a male screw portion 52; and a cylindrical portion 51*b* integrated therewith. The male screw portion 52 is screwed to a screw hole formed in an end portion of the piston 34, and the cylindrical portion 51*b* is supported axially movably by a guide cylinder 54 fixed to a supporting plate 53 within the drive box 41. The ball screw shaft 47 is incorporated inside and coaxially with the drive sleeve 51, and a nut 55 screwed to the ball screw shaft 47 is fixed to an opening end portion of the drive sleeve 51. The nut 55 has a screw portion 55*a* to be fitted inside the drive sleeve 51 and a flange portion 55*b* integrated therewith. The flange portion 55*b* is fastened to the drive sleeve 51 by a screw member (not shown). Therefore, when the motor 48 drives the ball screw shaft 47 for rotation, the drive sleeve 51 is guided by the guide cylinder 54 via the nut 55, thereby reciprocating axially linearly. A guide ring 56 is mounted on a tip portion of the ball screw shaft 47 so that the ball screw shaft 47 is not tilted when the ball screw shaft 47 is rotated, and this guide ring 56 is fitted to an inner peripheral surface of the drive sleeve 51.

Splines are formed on an inner peripheral surface of the guide cylinder 54 and an outer peripheral surface of the drive sleeve 51 in order to guide the drive sleeve 51 to axial movement. Therefore, if a ball is interposed between the both splines, when the piston 34 is driven by the motor 48 via the drive sleeve 51, sliding resistance of the drive sleeve 51 can be reduced and rotation of the drive sleeve 51 is restricted.

An outer peripheral surface of the large-diameter piston portion 34*a* of the piston 34 serves as a sliding face 62*a* which slidably contacts with a sliding face 61*a* which is an inner peripheral surface of the large-diameter cylinder hole 33*a*, and an outer peripheral surface of the small-diameter piston portion 34*b* serves as a sliding face 62*b* which slidably contacts with a sliding face 61*b* which is an inner peripheral surface of the small-diameter cylinder hole 33*b*. A bellows cover 64*a* for forming a first seal chamber 63*a* continuous to the sliding face 62*a* of the large-diameter piston portion 34*a* is provided between the large-diameter piston portion 34*a* and the cylinder 12. The bellows cover 64*a* includes: an annular portion 66 fixed to the large-diameter hole 65 formed in an opening portion located on a basal end portion side of the cylinder 12; an annular portion 67 fixed to a projection portion, i.e., a basal end portion of the large-diameter piston portion 34*a*; and a bellows portion 68 provided therebetween. The seal chamber 63*a* is formed inside the bellows cover 64*a* provided so as to cover the large-diameter piston portion 34*a*.

A bellows cover 64*b* serving as an elastically deformable member for forming a second seal chamber 63*b* continuous to the sliding face 62*b* of the small-diameter piston portion 34*b* is provided between the small-diameter piston portion 34*b* and the tip portion of the cylinder 12. The bellows cover 64*b* includes: a disk portion 72 fixed to a large-diameter hole 71 formed in an opening portion located on a tip portion side of the cylinder 12; an end plate portion 73 fixed to a projection portion of the small-diameter piston portion 34*b*, i.e., to a tip portion entering into the accommodating hole 35; and a bellows portion 74 provided therebetween. The disk portion 72 of the bellows cover 64*b* is fixed to the cylinder 12 using a fastening plate 76 attached to an end face of the cylinder 12 by bolts 75, so that the accommodating hole 35 is closed by the disk portion 72. Consequently, the seal chamber 63*b* is formed outside the bellows cover 64*b*, and the bellows cover 64*b* is provided coaxially with and continuously to the small-diameter piston portion 34*b*. An interior of the bellows cover 64*b* communicates with the outside through a through hole 77 formed in the fastening plate 76. Although each of the bellows covers 64*a* and 64*b* is formed of a resin material such as PTFE, it may be formed of a rubber material or metallic material. Incidentally, a diaphragm may be used instead of the bellows cover 64*b*.

Both the seal chambers 63*a* and 63*b* communicate with each other through a communication hole 78 formed in the cylinder 12. The incompressible medium 38*a* for sealing is enclosed in each of both the seal chambers 63*a* and 63*b*, and the enclosed incompressible medium 38*a* can move between both the seal chambers 63*a* and 63*b* through the communicating hole 78. As the incompressible medium 38*a* enclosed in each of the seal chambers 63*a* and 63*b*, the same kind of medium as that of the incompressible medium 38 enclosed in the drive chambers 18 and 36 is used. However, the incompressible medium 38*a* may be different from the incompressible medium 38 in kind. Incidentally, the communicating hole 78 may be formed in the piston 34 to allow both the seal chambers 63*a* and 63*b* to communicate with each other.

Because both the seal chambers 63*a* and 63*b* communicate with each other through the communicating hole 78, when the piston 34 is driven in a direction of contracting the drive chamber 36, the first seal chamber 63*a* is contracted so as to decrease its volume and the second seal chamber 63*b* is expanded so as to increase its volume. Consequently, the incompressible medium 38*a* in the first seal chamber 63*a* is exhausted through the communicating hole 78 and supplied to the second seal chamber 63*b*. On the other hand, when the piston 34 is driven in a direction of expanding the drive chamber 36, the volume of the first seal chamber 63*a* is expanded and the volume of the second seal chamber 63*b* is contracted. Therefore, the incompressible medium 38*a* in the second seal chamber 63*b* is exhausted through the communicating hole 78 and supplied to the first seal chamber 63*a*.

It is assumed that an average effective sectional area of the bellows portion 68 of the first bellows cover 64 is "A", an sectional area of the large-diameter piston portion 34*a* is "B", an average effective sectional area of the bellows portion 74 of the second bellows cover 64*b* is "C", and a sectional area of the small-diameter piston portion 34*b* is "D". At this time, the average effective sectional areas of the bellows portions 68 and 74 and the sectional areas of the large-diameter piston portion 34*a* and the small-diameter piston portion 34*b* are set so that "A−B=C−D". Accordingly, a volume reduction amount and a volume increase amount per unit stroke of the piston 34 in the respective seal chambers 63*a* and 63*b* become substantially equal to each other when the drive chamber 36 is expanded or contracted. Thus, when the piston 34 is reciprocated, an exhaust amount and a supply amount of the incompressible medium 38*a* within the seal chambers 63*a* and 63*b* are balanced. Therefore, the total volumes of the seal chambers 63*a* and 63*b* are not changed, and when the piston 34 is reciprocated, the bellows portions 68 and 74 are deformed only axially and not deformed radially.

To seal a region between the sliding face 61*a* of the large-diameter cylinder hole 33*a* and the sliding face 62*a* of the large-diameter piston portion 34*a*, a seal member 79*a* is mounted in an annular groove formed in the cylinder hole 33*a*, so that the sliding face 62*a* of the large-diameter piston portion 34*a* slidably contacts with the seal member 79*a*. To seal a region between the sliding face 61*b* of the cylinder hole 33*b* and the sliding face 62*b* of the small-diameter piston portion 34*b*, a seal member 79*b* is mounted in an annular groove formed in the cylinder hole 33*b*. Alternatively, the annular groove may be formed in each outer peripheral surface of the large-diameter piston portion 34*a* and the small-diameter piston portion 34*b* to mount the seal members 79*a* and 79*b* into the annular grooves. In this case, the seal members 79*a* and 79*b* slidably contact with the sliding faces 61*a* and 61*b* of the cylinder holes 33*a* and 33*b* when the piston 34 is reciprocated.

In this chemical liquid supplying apparatus 10*a*, since the incompressible medium 38 in the piston-side drive chamber 36 is pressurized by the piston 34 to supply the incompressible medium 38 to the pump-side drive chamber 18 from the piston-side drive chamber 36, the pressure in the pump-side drive chamber 18 can be increased. The incompressible medium 38 in the piston-side drive chamber 36 is sealed by the seal members 79*a* and 79*b*. When the drive chamber 36 is pressurized by the piston 34, the incompressible medium 38 adhering to the sliding faces 62*a* and 62*b* passes, due to the pressure in the drive chamber 36, through slight gaps between the seal members 79*a* and 79*b* and the sliding faces 62*a* and 62*b*, and the incompressible medium 38 is guided to the outside and leaked from the drive chamber 36. However, the incompressible medium 38 adhering to the outer peripheral surfaces of the large-diameter piston portion 34*a* and the small-diameter piston portion 34*b* and leaking to the outside is taken into the incompressible medium 38*a* in the seal chambers 63*a* and 63*b*, thereby not leaking to an exterior of the apparatus. Because the bellows covers 64*a* and 64*b* have no sliding portion, the incompressible medium 38 leaking from regions between the sliding faces 61*a* and 61*b* and the sliding faces 61*b* and 62*b* is prevented from leaking to the outside from the seal chambers 63*a* and 63*b* or being scattered.

Since the incompressible medium 38 in both the drive chambers 18 and 36 is in a negative pressure state when the volume of the piston-side drive chamber 36 is increased by moving the piston 34 backward, even if the incompressible medium 38*a* enclosed in the seal chambers 63*a* and 63*b* flows back and enters into the drive chamber 36, both end portions of the piston 34 are shielded from the outside by the bellow covers 64*a* and 64*b* and no external air enters into the drive chambers 18 and 36.

Further, because molecular weight of the incompressible media 38 and 38*a* such as liquid is larger than that of air, it is difficult that the incompressible media pass through fine gaps between the seal materials 79*a* and 79*b* and both of the sliding faces 61*a* and 61*b* and the sliding faces 62*a* and 62*b*. Therefore, the amount of the incompressible medium 38*a* entering into the drive chamber 36 from the seal chambers 63*a* and 63*b* decreases in comparison with air. Thus, discharge accuracy of the chemical liquid from the pump 11 can be kept at a high level in a long period of time by enclosing the incompressible medium 38*a* such as liquid in the seal chambers 63*a* and 63*b*.

Further, the seal members 79*a* and 79*b* for sealing regions between the sliding faces 62*a* and 62*b* of the piston 34 and the sliding faces 61*a* and 61*b* of the cylinder holes 33*a* and 33*b* are used as boundaries to fill both axial-directional sides of each of the regions with the incompressible media 38 and 38*a*. Accordingly, the incompressible media 38 and 38*a*, which have become thin-film shapes, are interposed between the seal members 79*a* and 79*b* and the outer peripheral surface of the piston 34, whereby lubricity properties of the seal members 79*a* and 79*b* are enhanced and the frictional wear of the seal members 79*a* and 79*b* is prevented. Consequently, durability of the seal members 79*a* and 79*b* is improved, and lifetime of the apparatus can be prolonged.

Further, even when the seal members 79*a* and 79*b* are worn due to use in a long period and their seal properties are reduced, air can be prevented from entering into the drive chambers 18 and 36, so that a reciprocation stroke of the piston 34 can be caused to correspond to the discharge amount of chemical liquid from the flexible tube 16 with high accuracy. Therefore, when photoresist liquid is applied to a liquid crystal glass substrate, a predetermined amount of photoresist liquid can be discharged from the application nozzle 29 with high accuracy.

In order to detect pressure of the incompressible medium 38*a* in the seal chambers 63*a* and 63*b*, a seal-chamber pressure sensor 81 serving as seal-chamber pressure detecting means is attached to the cylinder 12. In order to detect pressure of the incompressible medium 38 in the drive chamber 36, a drive-chamber pressure sensor 82 serving as drive-chamber pressure detecting means is attached to the pump case 14. The respective sensors 81 and 82 output electric signals corresponding to their pressure. As shown in FIG. 1, the seal-chamber pressure sensor 81 detects the pressure in the second seal chamber 63*b*. However, the pressure in the first seal chamber 63*a* is equal to that in the second seal chamber 63*b*, so that the seal-chamber pressure sensor 81 may detect the pressure in the first seal chamber 63*a*.

Figure 3:
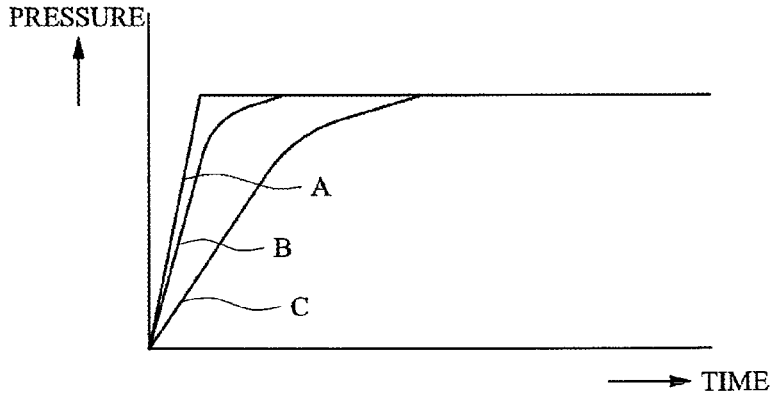
FIG. 3 is a graph showing a pressure change of chemical liquid in a pump chamber at a time of starting a chemical-liquid discharge process.

FIG. 3 is a graph showing a pressure change of the chemical liquid in the pump chamber 17 at a time of starting a chemical-liquid discharge process of contracting the pump chamber 17 by moving the piston 34 forward in a direction of contacting the piston-side drive chamber 36. This pressure change substantially corresponds to a pressure change of the incompressible medium within the drive chambers 18 and 36.

A waveform "A" in FIG. 3 indicates a pressure change characteristic of the pump chamber 17 when the seal members 79*a* and 79*b* exert a desired sealing effect. When the discharge is started, the pressure in the pump chamber 17 changes so as to rise up steeply, so that the pressure is detected by the drive-chamber pressure sensor 82. Such a steep change can be achieved by forming the drive chamber 36 using the piston 34 instead of the bellows. However, if the seal members 79*a* and 79*b* are worn or the sliding faces 62*a* and 62*b* of the piston 34 and the sliding faces 61*a* and 61*b* of the cylinder hole 33 are worn so that the sealing properties between the sliding faces 61*a* and 61*b* and the sliding faces 62*a* and 62*b* are deteriorated, the amount of the incompressible medium 38 leaking into the seal chambers 63*a* and 63*b* from the drive chamber 36 increases. Consequently, the characteristic indicated by the waveform A cannot be maintained, and a smooth rising change as shown by a waveform "B" to a waveform "C" occurs according to progress of deterioration of the sealing properties.

That is, when the sealing properties are deteriorated, movement resistance of the incompressible medium 38 from the drive chamber 36 to the seal chambers 63*a* and 63*b* becomes small at a time of discharging the chemical liquid, so that the amount of medium leaking from the drive chamber 36 increases. Therefore, a thrust force of the piston 34 is not accurately transmitted to the pressure in the drive chambers 18 and 36, whereby the characteristic of the drive chambers 18 and 36 becomes smooth rising as shown by the waveforms B and C in FIG. 3. As the pressure in the drive chamber 36 can be detected by the drive-chamber pressure sensor 82, when the rising characteristic exceeds its tolerable value, it is possible to determine a period of replacing the seal members 79*a* and 79*b* due to the deterioration of the sealing properties exceeding their tolerable ranges.

When the chemical liquid is sucked into the pump chamber 17 by moving the piston 34 backward, the pressure in the pump chamber 17 hardly needs to be changed steeply. However, if the sealing property is deteriorated, the amount of the incompressible medium 38*a* moving from the seal chambers 63*a* and 63*b* to the drive chamber 36 at a pump-suction process increases, so that the period of replacing the seal members 79*a* and 79*b* can be determined also by the pressure change of the drive chamber 36 at the time of suction.

Therefore, a deterioration degree of the sealing property, i.e., a leakage degree of the incompressible media 38 and 38*a* can be detected according to an output signal from the seal-chamber pressure sensor 81 for detecting the pressure in the seal chambers 63*a* and 63*b* and an output signal from the drive-chamber pressure sensor 82 for detecting the pressure in the drive chamber 36.

Figure 4:
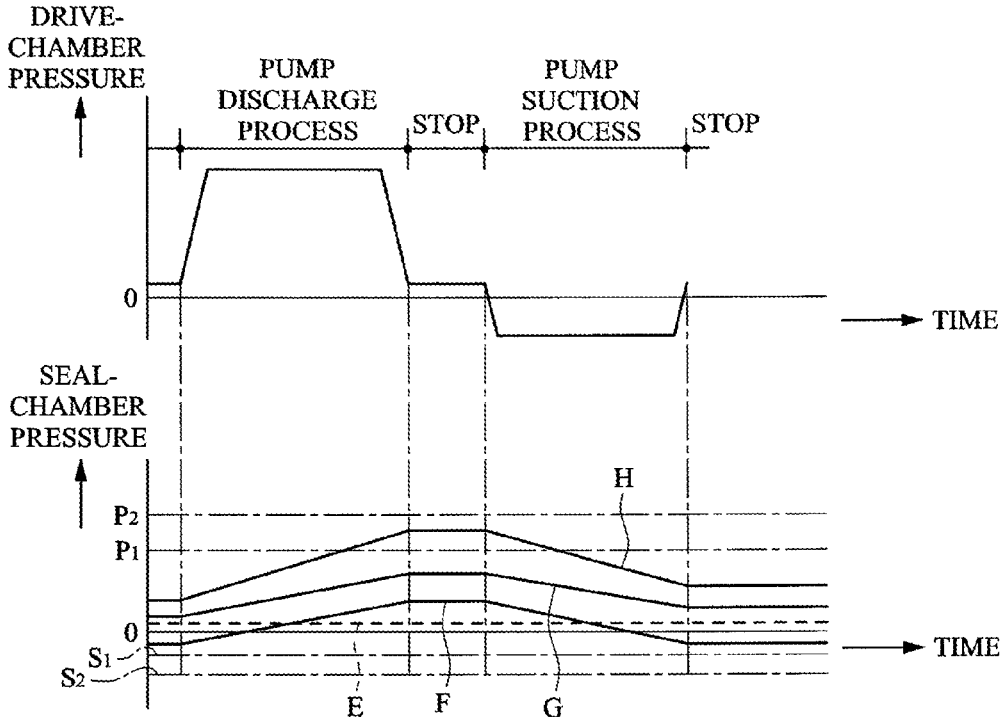
FIG. 4 is graphs showing respective changes of drive-chamber pressure and seal-chamber pressure at a cycle of a pump discharge process and a pump suction process.

FIG. 4 is a graph showing each of changes in drive-chamber pressure and seal-chamber pressure in a single cycle of a pump discharge process and a pump suction process.

In the pump discharge process of advancing the piston 34 and in the pump suction process of retracting the piston 34, the pressure in the drive chambers 18 and 36 changes with time as shown by the graph of the drive-chamber pressure in FIG. 4. In contrast, if the seal members 79*a* and 79*b* exercise desired sealing properties, the leakage of the incompressible medium 38 into the seal chambers 63*a* and 63*b* from the sliding faces 61*a*, 61*b*, 62*a*, and 62*b* does not occur, so that both in the pump discharge process and the pump suction process by reciprocating the piston 34, the pressure in the seal chambers 63*a* and 63*b* maintains an initial value "E" without any change. Although the initial value E may be slightly higher than a gauge pressure of zero since the incompressible medium 38*a* is enclosed in the seal chambers 63*a* and 63*b*, this initial value may be set to zero or any value under negative pressure.

If the deterioration of the sealing property progresses, the amount of the incompressible medium 38 leaking to the seal chambers 63*a* and 63*b* from the drive chamber 36 in the pump discharge process increases so that the pressure in the seal chambers 63*a* and 63*b* becomes higher than the initial value E. Contrary to this, the amount of the incompressible medium 38*a* leaking to the drive chamber 36 from the seal chambers 63*a* and 63*b* increases in the pump suction process, and the pressure in the seal chambers 63*a* and 63*b* becomes lower than the initial value, whereby a negative pressure value increases with respect to a gauge pressure of zero. Thus, a leakage degree due to the deterioration of the sealing property can be determined by detecting the pressure in the seal chambers 63*a* and 63*b*. Incidentally, although the pressure change of the seal chambers 63*a* and 63*b* is lower than that of the drive chambers 18 and 36, the pressure change of the seal chambers 63*a* and 63*b* in FIG. 4 is shown so as to be larger than that of the drive chamber in order to be easily understood.

It is assumed that, as shown by the seal-chamber pressure in FIG. 4, two values of thresholds "P1" and "P2" are set as a pressure value for determining the deterioration degree of the sealing property at the time of discharge. At this time, when the pressure value exceeds the threshold P1, it is possible to determine by a detection signal from the seal-chamber pressure sensor 81 that the deterioration of the sealing property progresses to some extent. When the pressure value exceeds the threshold P2, it is possible to determine that the sealing property is deteriorated to such an extent that the seal members 79*a* and 79*b* need to be replaced. On the other hand, if two values of thresholds "S1" and "S2" are set as deterioration determining pressure values in a pump suction process, a deterioration degree can be determined in the same manner.

Even if the deterioration degree of the sealing property is the same, the pressure change of the seal chambers 63*a* and 63*b* differs depending on the pressure in the drive chambers 18 and 36 due to viscosity of the chemical liquid and flow resistance of the discharge-side flow path 26. For this reason, the threshold for determining the deterioration of the sealing property can be varied according to the pressure in the drive chambers 18 and 36.

Characteristic lines "F" and "G" in FIG. 4 show the pressure change of the seal chambers 63*a* and 63*b* when wear of the seal members 79*a* and 79*b* starts and the sealing property is deteriorated slightly. The characteristic line F indicates the pressure change of the seal chambers 63*a* and 63*b* when the pressure in the drive chambers 18 and 36 does not rise high in the pump discharge process similarly to the case where viscosity of chemical liquid is low or where flow resistance of the discharge-side flow path 26 of the pump 11 is low. Because the pressure in the drive chambers 18 and 36 does not rise high, it becomes lower than a gauge pressure of zero in the pump suction process.

In contrast, even when the deterioration degree of the sealing property is the same as a case shown by the characteristic line F, a case where the pressure in the pump chamber 17 in the pump discharge process may be higher than the above-mentioned case is a case where the viscosity of the chemical liquid is high or where the discharge-side flow path is provided with the filter. In this time, the pressure in the seal chambers 63*a* and 63*b* becomes higher than the characteristic line F and the pressure at a time of stopping the pump is also higher than the initial value. Further, when the pressure in the pump chamber 17 is high, the pressure in the seal chambers 63*a* and 63*b* at the time of stopping the pump gradually rises up from the initial value E. However, the pressure at the time of stopping the pump may return to an initial condition because of a change in a pump operating condition. For example, such a case includes a condition in which the pump is stopped in a long period of time or which interiors of the drive chambers 18 and 36 become in negative pressure states by increasing flow velocity at a time of suction.

When the pressure in the drive chambers 18 and 36 in the pump discharge process does not rise up similarly to the case shown by the characteristic line F, if the deterioration of the sealing property progresses, the leakage degree of the incompressible media 38 and 38*a* is increased so that the pressure in the seal chambers 63*a* and 63*b* in the pump discharge process exceeds the threshold P1. Thus, the deterioration degree of the sealing property can be determined by detecting the pressure in the seal chambers 63*a* and 63*b* using the seal-chamber pressure sensor 81. If the amount of leakage of the medium increases further, the pressure in the seal chambers 63*a* and 63*b* exceeds the threshold P2.

The pressure change of the drive-chamber pressure and the seal-chamber pressure in a cycle shown in FIG. 4 is typical and is varied depending on a way of operating the pump and a deterioration condition of the sealing property. For example, as deterioration of the sealing property progresses, the pressure change of the drive-chamber pressure and the seal-chamber pressure gradually shows a graph close to the pressure change of the seal chamber.

Figure 5:
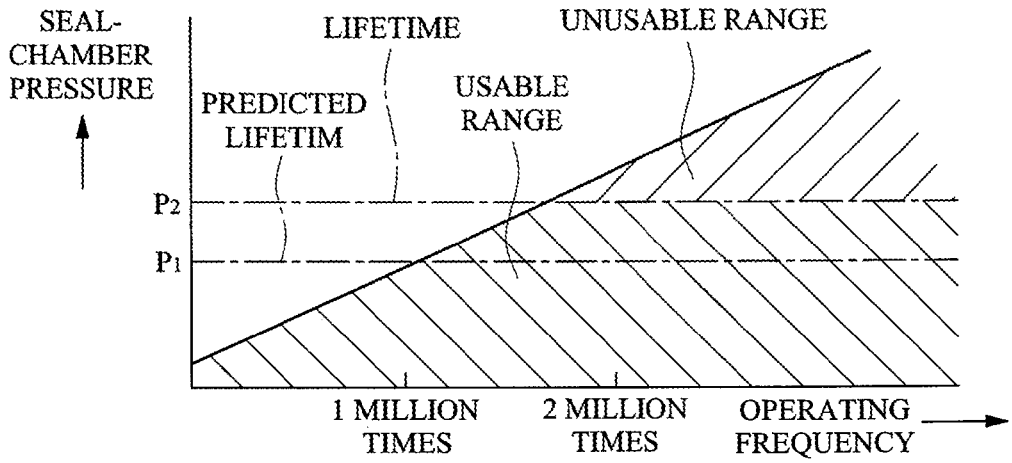
FIG. 5 is a graph showing schematically an example of a change of a peak value of the pressure in the seal chamber at the pump discharge process according to an increase of an operation frequency of the pump.

FIG. 5 is a graph showing schematically an example of a change of a peak value of the seal-chamber pressure in the pump discharge process according to an increase of the operating frequency of the pump. It is assumed that the threshold P2 shown in FIG. 4 is a replacement period of the seal member, i.e., a lifetime of the seal member. At this time, if the operating frequency of the pump carried out until the seal-chamber pressure reaches the threshold P2 from the threshold P1 is previously known, the lifetimes of the seal members 79*a* and 79*b* can be predicted when the seal-chamber pressure exceeds the threshold P1. Further, if the relationship between the operating frequency and the peak value of the seal-chamber pressure is previously known, the lifetime of the seal member can be predicted from any detection pressure. Incidentally, the lifetime of the seal member can be predicted in the pump suction process based on the thresholds S1 and S2 shown in FIG. 4.

Figure 6:
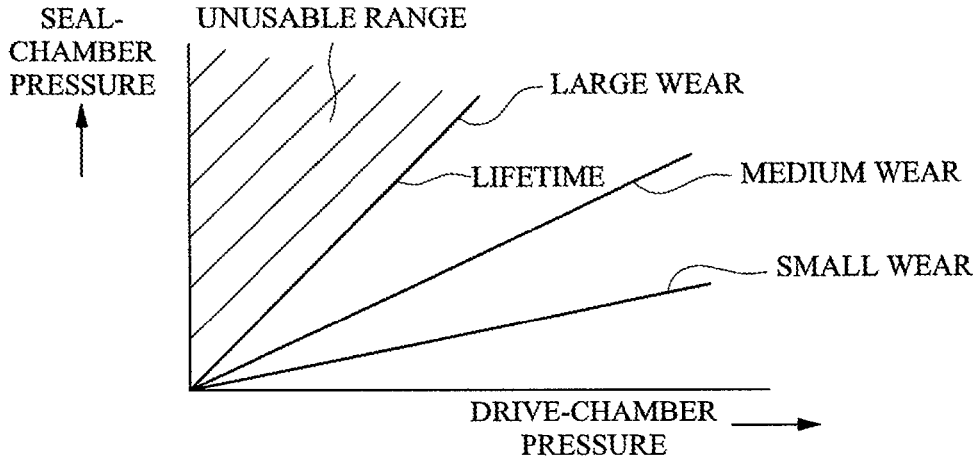
FIG. 6 is a graph showing a relationship between the drive-chamber pressure and the seal-chamber pressure at the pump discharge process.

FIG. 6 is a graph showing a relationship between the pressure in the drive chambers 18 and 36 and the pressure in the seal chambers 63*a* and 63*b* in the pump discharge process. As shown in FIG. 6, as the pressure in the drive chambers 18 and 36 increases, the amount of leakage of the medium to the seal chambers 63*a* and 63*b* increases, and as the deterioration of the sealing property progresses, the amount of leakage of the medium is increased. Consequently, there is such a tendency that as the pressure in the drive chambers 18 and 36 increases, the pressure in the seal chambers 63*a* and 63*b* becomes high. Therefore, if the operation of the pump is carried out under the fixed condition and the pump pressure at the chemical-liquid discharge is constant, the lifetimes of the seal members 79*a* and 79*b* can be determined by the pressure change of the seal chambers 63*a* and 63*b*. If the pressure in the pump chamber 17 at the chemical-liquid discharge rises according to progress of a clogging of the filter 28 provided in the discharge-side flow path 26, the pressure in the seal chambers 63*a* and 63*b* may exceed the threshold even if the seal members 79*a* and 79*b* have not reached the lifetimes.

The pressure in the drive chamber 36 is detected by the drive-chamber pressure sensor 82. Therefore, for example, if the deterioration of the sealing property is determined by a difference between the pressure in the drive chamber 36 and the pressure in the seal chambers 63*a* and 63*b*, or if the threshold of the pressure in the seal chambers 63*a* and 63*b* is varied according to the pressure in the drive chamber 36, the lifetimes of the seal members 79*a* and 79*b* can be accurately determined irrespectively of the pressure change of the discharge-side flow path 26 due to clogging of the filter.

Figure 7:
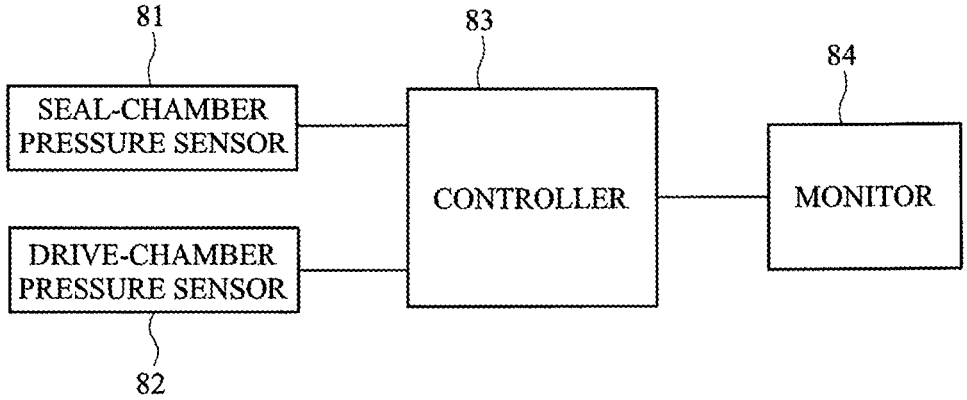
FIG. 7 is a block diagram showing a control circuit of the chemical liquid supplying apparatus.

FIG. 7 is a block diagram showing a control circuit of the chemical liquid supplying apparatus, whereby detection signals of the seal-chamber pressure sensor 81 and the drive-chamber pressure sensor 82 are sent to a controller 83 and a signal is sent to a monitor 84 from the controller 83, so that the sealing property is displayed on the monitor 84. The controller 83 includes: a ROM in which control program, lifetime computing equation, data table of thresholds, and the like are stored; a micro processor for computing the deterioration degree of the sealing property based on the detection signal; and the like. Thus, as shown in FIG. 4, the deterioration degree of the sealing property is determined by the pressure in the seal chambers 63*a* and 63*b*, the pressure in the drive chamber 36, or the pressure in the seal chambers 63*a* and 63*b* as well as the pressure in the drive chamber 36. The monitor 84 displays the deterioration degree thereof, comings of the lifetimes of the seal members 79*a* and 79*b*, or prediction about coming periods of the lifetimes of the seal members 79*a* and 79*b*. When the seal members 79*a* and 79*b* reach the lifetimes, alarms may be issued or alarm lamps may be lit in addition to the monitor 84.

Figure 8A:
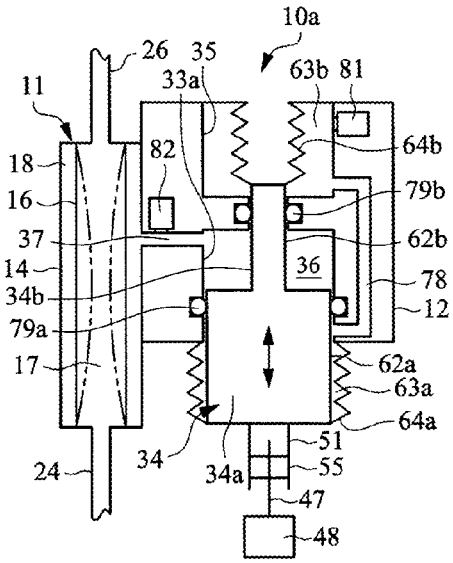
FIG. 8A is a schematic view of the chemical liquid supplying apparatus shown in FIG. 1.

FIG. 8A is a schematic view of the chemical liquid supplying apparatus 10*a* shown in FIG. 1, and FIGS. 8B to 8D and FIGS. 9A to 9D are schematic views showing modifications of the chemical liquid supplying apparatus. In the respective drawings, members common to those in the chemical liquid supplying apparatus shown in FIG. 8A are denoted by the same reference numerals.

Figure 8B:
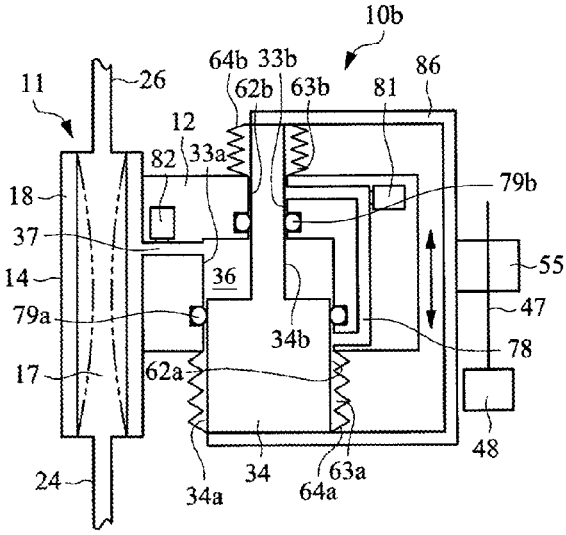
FIG. 8B is a schematic view showing a modification of the chemical liquid supplying apparatus.

Similarly to the chemical liquid supplying apparatus 10*a*, a chemical liquid supplying apparatus 10*b* shown in FIG. 8B comprises the cylinder 12 in which the large-diameter cylinder hole 33*a* and the small-diameter cylinder hole 33*b* are formed, and the piston 34 has the large-diameter piston portion 34*a* fitted to the large-diameter cylinder hole 33*a* and the small-diameter piston portion 34*b* fitted to the small-diameter cylinder hole 33*b*. The first bellows cover 64*a* is provided between the large-diameter piston portion 34*a* and one end portion of the cylinder 12 so as to cover the large-diameter piston portion 34*a* similarly to the cases shown in FIGS. 1 and 8A.

On the other hand, between the small-diameter piston portion 34*b* and the other end portion of the cylinder 12, the second bellows cover 64*b* in the chemical liquid supplying apparatus 10*a* shown in FIGS. 1 and 8A is provided on an extension line of the small-diameter piston portion 34*b*, whereas the second bellows cover 64*b* in the chemical liquid supplying apparatus shown in FIG. 8B is provided so as to cover the small-diameter piston portion 34*b*. The bellows cover 64*a* has an end plate portion for covering an end face of the large-diameter piston portion 34*a*, and the first seal chamber 63*a* is formed inside the bellows cover 64*a*. The bellows cover 64*b* has an end plate portion for covering an end face of the small-diameter piston portion 34*b*, and the second seal chamber 63*b* is formed inside the bellows cover 64*b*. The end plate portions of both the bellows covers 64*a* and 64*b* are linked to a linking member 86, and a nut 55 screwed to the ball screw shaft 47 disposed in parallel to the piston 34 is attached to this linking member 86.

Figure 8C:
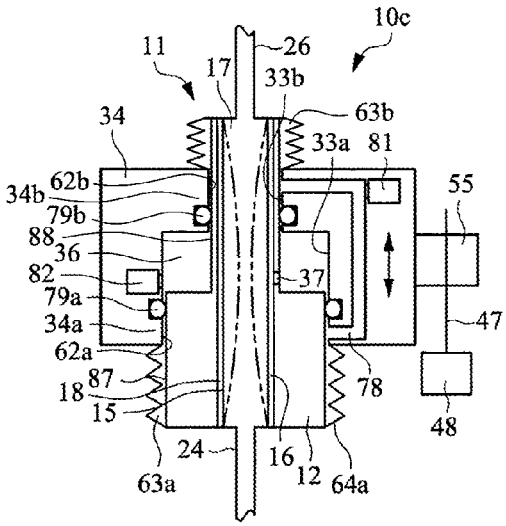
FIG. 8C is a schematic view showing another modification of the chemical liquid supplying apparatus.

In a chemical liquid supplying apparatus 10*c* shown in FIG. 8C, the cylindrical space 15 is formed in a center portion of the cylinder 12, the flexible tube 16 is incorporated in this space 15, and the pump chamber 17 inside the flexible tube and the drive chamber 18 outside the flexible tube are partitioned by the flexible tube 16. A large-diameter outer peripheral surface 87 and a small-diameter outer peripheral surface 88 are formed in the cylinder 12, and a hollow piston 34 having the large-diameter piston portion 34*a* fitted slidably to the large-diameter outer peripheral surface 87 and the small-diameter piston portion 34*b* fitted slidably to the small-diameter outer peripheral surface 88 is disposed outside the cylinder 12. The drive chamber 36 is formed between a radial-directional face serving as a boundary between the large-diameter outer peripheral surface 87 and the small-diameter outer peripheral surface 88 in the cylinder 12 and a radial-directional face serving as a boundary between the large-diameter piston portion 34*a* and the small-diameter piston portion 34*b* in the hollow piston 34. The drive chamber 36 communicates with the drive chamber 18 through the communicating hole 37.

The first bellows cover 64*a* is provided between one end portion of the cylinder 12 and the large-diameter piston portion 34*a*, and the first seal chamber 63*a* continuous to the sliding face 62*a* is formed between the large-diameter piston portion 34*a* and the bellows cover 64*a*. Further, the second bellows cover 64*b* is provided between the other end portion of the cylinder 12 and the small-diameter piston portion 34*b*, and the second seal chamber 63*b* continuous to the sliding face 62*b* is formed by the small-diameter piston portion 34*b* and the bellows cover 64*b*. In order to reciprocate axially the piston 34, the nut 55 screwed to the ball screw shaft 47 disposed in parallel to the piston 34 is attached to the piston 34.

The chemical liquid supplying apparatuses 10*b* and 10*c* shown in FIGS. 8B and 8C, in which the ball screw shaft 47 is parallel to the piston 34, can be made smaller in apparatus linear dimension than the chemical liquid supplying apparatus 10*a* in which the ball screw shaft 47 is disposed coaxially with the piston 34.

Figure 8D:
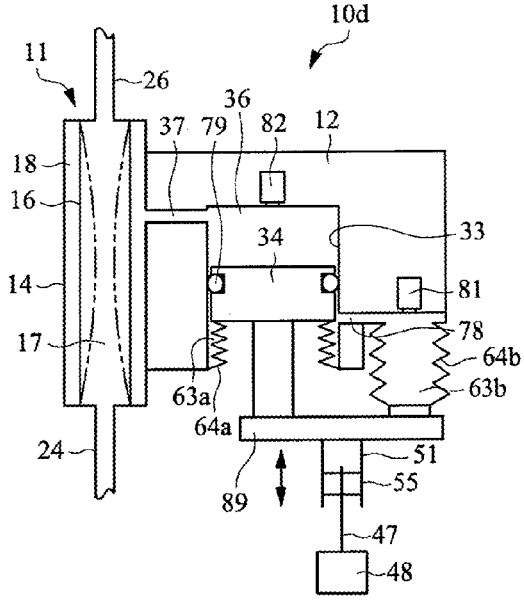
FIG. 8D is a schematic view showing still another modification of the chemical liquid supplying apparatus.

In a chemical liquid supplying apparatus 10*d* shown in FIG. 8D, the first bellows cover 64*a* is provided between an opening end portion of the cylinder 12 in which the piston 34 is incorporated axially reciprocably and an end portion of the piston 34, and the first seal chamber 63*a* is formed between an exterior of the bellows cover 64*a* and the cylinder hole 33. The second bellows cover 64*b* is attached to the cylinder 12 in parallel to the first bellows cover 64*a* so as to be deformable axially elastically, and the second seal chamber 63*b* communicating with the seal chamber 63*a* through the communicating hole 78 is formed inside this bellows cover 64*b*.

Similarly to the case shown in FIG. 1, the drive sleeve 51 reciprocating axially by the motor 48 serving as a driving means is attached to a linking member 89 linked to the piston 34 and the bellows cover 64*b*. The piston 34 shown in FIG. 8D has no step unlike the above-described pistons, and a region between the piston 34 and the cylinder hole 33 is sealed by a single seal member 79.

Figure 9A:
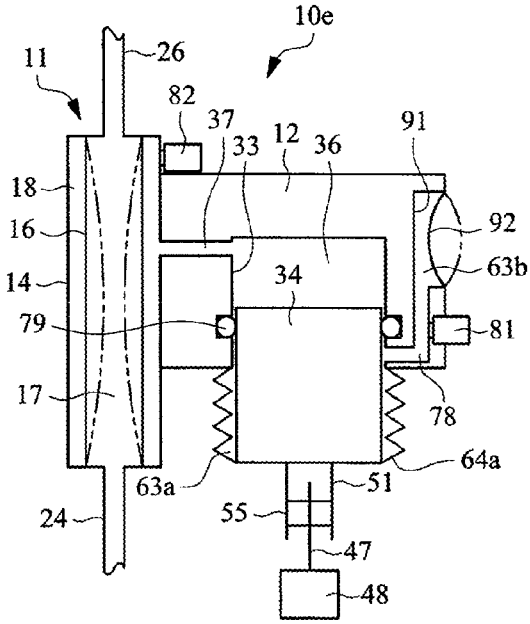
FIG. 9A is a schematic view showing a modification of the chemical liquid supplying apparatus.

In a chemical liquid supplying apparatus 10*e* shown in FIG. 9A, the first bellows cover 64*a* is provided between the opening end portion of the cylinder 12 in which the piston 34 is incorporated axially reciprocably and a projection end portion of the piston 34, and the first seal chamber 63*a* is formed between the interior of the bellows cover 64*a* and the piston 34. A concave portion 91 which communicates with the seal chamber 63*a* through the communicating hole 78 is formed in the cylinder 12, and the second seal chamber 63*b* is formed by a diaphragm 92 attached to the cylinder 12 so as to cover the concave portion 91. In the chemical liquid supplying apparatus 10*e*, when the piston 34 reciprocates axially so that the first seal chamber 63*a* is expanded/contracted, the second seal chamber 63*b* is expanded/contracted by elastic deformation of the diaphragm 92 correspondingly thereto.

Figure 9B:
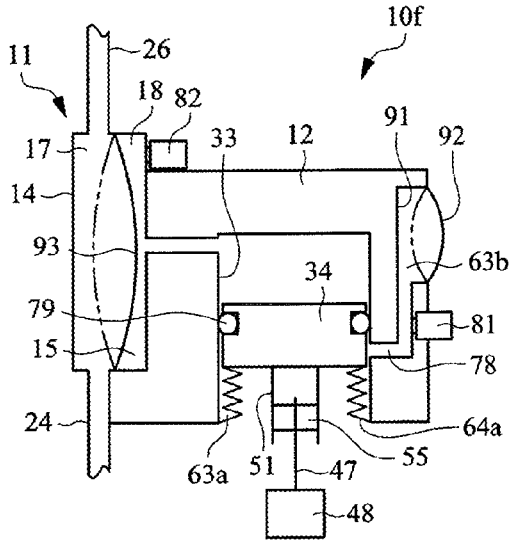
FIG. 9B is a schematic view showing another modification of the chemical liquid supplying apparatus.

In a chemical liquid supplying apparatus 10*f* shown in FIG. 9B similarly to the chemical liquid supplying apparatus 10*e* shown in FIG. 9A, the second seal chamber 63*b* is formed by the diaphragm 92. Contrary to this, unlike the chemical liquid supplying apparatuses 10*a* to 10*e*, the pump 11 has a diaphragm 93, and the space 15 within the pump case 14 is partitioned into the pump chamber 17 and the drive chamber 18 by the diaphragm 93. Thus, in the chemical liquid supplying apparatus 10*f*, there is used the diaphragm 93 serving as an elastically deformable partition film which partitions the drive chamber 18 and the pump chamber 17 for communicating with the fluid inflow port and the fluid outflow port. The first seal chamber 63*a* shown in FIG. 9B is formed between the interior of the cylinder hole 33 and the exterior of the bellows cover 64*a* similarly to the case shown in FIG. 8D.

Figure 9C:
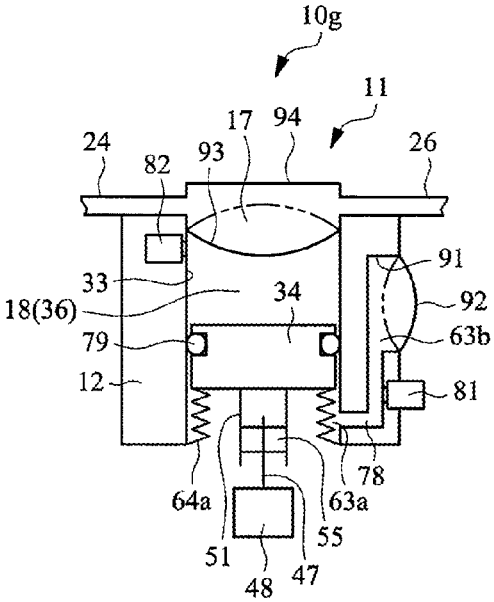
FIG. 9C is a schematic view showing still another modification of the chemical liquid supplying apparatus.

A chemical liquid supplying apparatus 10*g* shown in FIG. 9C has a pump case 94 attached to a tip opening portion of the cylinder 12 so as to cover the opening portion of the cylinder 12, and the diaphragm 93 is provided between the pump case 94 and a tip face of the cylinder 12 so as to opposes the piston 34. The pump chamber 17 and the drive chamber 18 are formed by the diaphragm 93, and the drive chamber 18 simultaneously serves also as the drive chamber 36.

Figure 9D:
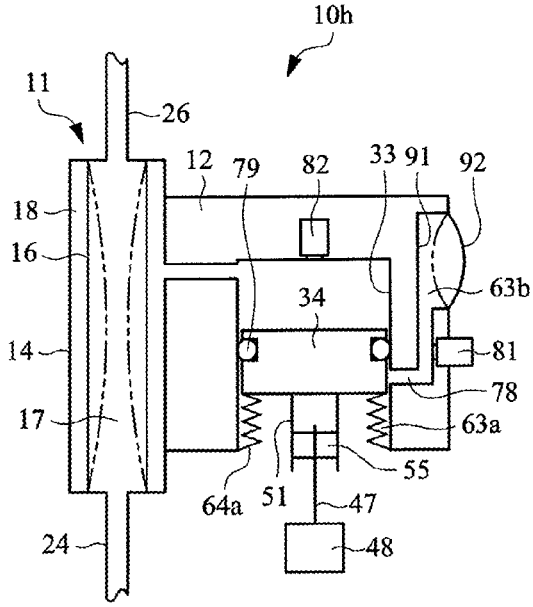
FIG. 9D is a schematic view showing yet still another modification of the chemical liquid supplying apparatus.

In a chemical liquid supplying apparatus 10*h* shown in FIG. 9D similarly to the chemical liquid supplying apparatus 10*f* and 10*g* shown in FIGS. 9B and 9C, the first seal chamber 63*a* is formed between the exterior of the bellows cover 64*a* and the interior of the cylinder hole 33, and the other structure is equal to that of the chemical liquid supplying apparatus 10*e* shown in FIG. 9A. The piston 34 of the chemical liquid supplying apparatuses 10*e* to 10*h* shown in FIGS. 9A to 9D has no step similarly to the case shown in FIG. 8D, so that the piston 34 is provided with one seal member 79, which results in contacting with the sliding face of the cylinder hole 33 to seal the incompressible medium.

The pressure in the seal chambers 63*a* and 63*b* shown in FIGS. 8B to 8D and FIGS. 9A to 9D is detected by the seal-chamber pressure sensor 81, and the pressure in the drive chambers 18 and 36 is detected by the drive-chamber pressure sensor 82, whereby the lifetimes of the seal members 79, 79*a*, and 79*b* are determined.

The chemical liquid supplying apparatuses shown in FIGS. 8A to 8D and FIGS. 9A to 9D are classified for each type as follows.

Each of the chemical liquid supplying apparatuses 10*a* to 10*h* has a basic structure for supplying and exhausting the incompressible medium 38 to and from the drive chamber 18 of the pump 11 by reciprocating the piston 34 axially with respect to the cylinder 12. The type of the pump 11 includes: a type of using, as shown in FIGS. 9B and 9C, the diaphragm 93 as an elastically deformable partition film for partitioning the pump chamber 17 and the drive chamber 18; and a type of using the flexible tube 16 as shown in FIGS. 8A to 8D and FIGS. 9A and 9D.

In each of the chemical liquid supplying apparatuses 10*a* to 10*h*, the seal chamber for accommodating the incompressible medium 38 leaking from the drive chambers 18 and 36 comprises two, i.e., first and second chambers, and each of the first and second seal chambers 63*a* and 63*b* is formed of an elastic deformable member such as the diaphragm and the bellows cover. In each of the chemical liquid supplying apparatuses 10*a* to 10*h*, the first seal chamber 63*a* is formed by the bellows cover 64*a*.

On the other hand, the second seal chamber 63*b* in each of the chemical liquid supplying apparatuses 10*e* to 10*h* is formed by the diaphragm 92, and the diaphragm 92 is of a medium driven type of being expanded/contracted by the incompressible medium 38*a* flowing into the second seal chamber 63*b*. A bellows may be used as an elastic deformable member instead of the diaphragm 92. Contrary to this, in the chemical liquid supplying apparatuses 10*a* to 10*d*, the second seal chamber 63*b* is also formed by the bellows cover 64*b* and simultaneously both the bellows covers 64*a* and 64*b* become of synchronous driving types of being driven together by driving means and become of such a balance type of balancing their volumes that when the seal chamber 63*a* is expanded, the seal chamber 63*b* is contracted. However, when both the bellows covers 64*a* and 64*b* are synchronized, the chemical liquid supplying apparatus 10*a* shown in FIG. 8A is such that when the bellows cover 64*a* is axially expanded, the bellows cover 64*b* is expanded, whereas the other synchronous type chemical liquid supplying apparatuses 10*b* to 10*d* are such that when the bellows cover 64*a* is axially expanded, the bellows cover 64*b* is axially contracted. If the bellows cover 64*a* is axially contracted, the bellows cover 64*b* is axially expanded.

A type in which the second seal chamber 63*b* is formed by the bellows cover 64*b* includes: a type of disposing coaxially both the bellows covers 64*a* and 64*b* as shown in FIGS. 8A to 8C; and a type of disposing them in parallel as shown in FIG. 8D. In the type of disposing coaxially the bellows covers, as shown in FIGS. 8A and 8B, the large-diameter piston portion 34*a* and the small-diameter piston portion 34*b* are formed in the piston 34, and the large-diameter piston portion 34*a* and the small-diameter piston portion 34*b* are provided with the bellows covers 64*a* and 64*b*, respectively. On the other hand, in the chemical liquid supplying apparatus 10*c* shown in FIG. 8C, the outer peripheral surface of the cylinder 12 is provided with the large-diameter outer peripheral surface 87 and the small-diameter outer peripheral surface 88, the hollow piston 34 is fitted axially slidably outside the cylinder 12, and the pump 11 is formed inside the cylinder 12. Thus, there are the type of disposing the piston 34 inside the cylinder 12 and the type of disposing, outside the cylinder 12, the piston 34 formed into a hollow shape.

In the type of disposing coaxially both of the bellows covers 64*a* and 64*b*, the respective seal chambers 63*a* and 63*b* communicate with each other through the communicating hole 78 so that the incompressible medium leaking from the piston 34 enters into each of them. The two seal members 79*a* and 79*b* are used to seal a gap between the piston 34 and the cylinder 12. In the chemical liquid supplying apparatuses 10*d* and 10*e* to 10*h* of other types, one seal member 79 is used between the piston 34 and the cylinder 12.

When the two seal members 79*a* and 79*b* are used, if at least one of the seal members is worn beyond the predetermined value, such excess frictional wear can be determined according to the signal from the sensor. In each of the chemical liquid supplying apparatuses, the seal member is provided. However, by making the gap between the cylinder 12 and the piston 34 small, the sealing property therebetween can be secured without using the seal member. In such a case, the period of replacing the piston and the like can be determined according to the deterioration degree of the sealing property by detecting each pressure in the seal chamber and the drive chamber.

The detailed structures of the chemical liquid supplying apparatuses shown in FIGS. 8A to 8C and 9A to 9D have been already proposed by the present inventor and described in the specification of Japanese Patent Application No. 2006-291153 filed.

The present invention is not limited to the above-described embodiments and may be variously modified within a scope of not departing from the gist thereof. For example, although the piston 34 is driven by the motor 48, the driving means is not limited to the motor 48 and other driving means such as a pneumatic cylinder may be used. Further, the seal-chamber pressure detecting means and the drive-chamber pressure detecting means are not limited to sensors for transmitting an electric signal according to the pressure, and a switch for issuing an ON signal when each pressure exceeds a predetermined value may be used or pressure according to which a member is moved may be displayed outside.

What is claimed is:

1. A chemical liquid supplying apparatus comprising:

a pump provided with an elastically deformable partition film for partitioning a pump-side drive chamber and a pump chamber communicating with a liquid inflow port and a liquid outflow port;

a cylinder connected to the pump, a large-diameter cylinder hole and a small-diameter cylinder hole being formed in the cylinder;

a piston having a large-diameter piston portion fitted into the large-diameter cylinder hole and a small-diameter piston portion fitted into the small-diameter cylinder hole, mounted axially reciprocably inside the cylinder, forming in the cylinder a piston-side drive chamber communicating with the pump-side drive chamber, and supplying/exhausting an incompressible medium to/from the pump-side drive chamber;

a bellows cover provided between, and coupled to, the large-diameter piston portion and the cylinder, and forming a first seal chamber continuous to a sliding face of the large-diameter piston portion;

an elastic deformable member provided between, and coupled to, the small-diameter piston portion and the cylinder, and forming a second seal chamber continuous to a sliding face of the small-diameter piston portion, the second seal chamber communicating with the first seal chamber;

the incompressible medium enclosed in the first and second seal chambers;

a drive means for axially reciprocating the piston to expand/contract the pump chamber by moving the incompressible medium in the piston-side drive chamber and the pump-side drive chamber; and a pressure detecting means for detecting pressure in at least one of the seal chamber and the drive chamber.

2. The chemical liquid supplying apparatus according to claim 1, wherein the elastic deformable member is a bellows cover.

* * * * *